US007732698B2

(12) United States Patent
Ikeda

(10) Patent No.: US 7,732,698 B2
(45) Date of Patent: Jun. 8, 2010

(54) ELECTRONIC KEYBOARD INSTRUMENT HAVING A KEY DRIVER

(75) Inventor: Takashi Ikeda, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 12/053,214

(22) Filed: Mar. 21, 2008

(65) Prior Publication Data

US 2009/0007761 A1 Jan. 8, 2009

(30) Foreign Application Priority Data

Mar. 23, 2007 (JP) ..... 2007-077196

(51) Int. Cl.
*G10H 1/00* (2006.01)

(52) U.S. Cl. ..... 84/609; 84/649

(58) Field of Classification Search ..... 84/600–602, 84/609, 612, 615, 636, 645, 649, 652, 668, 84/666
See application file for complete search history.

(56) References Cited

U.S. PATENT DOCUMENTS

| | | | | |
|---|---|---|---|---|
| 4,242,936 | A * | 1/1981 | Swain | 84/635 |
| 5,792,971 | A * | 8/1998 | Timis et al. | 84/609 |
| 6,051,762 | A * | 4/2000 | Fujiwara et al. | 84/21 |
| 6,169,243 | B1 | 1/2001 | Ito | |
| 6,417,439 | B2 * | 7/2002 | Uehara et al. | 84/645 |
| 6,472,589 | B1 * | 10/2002 | Lee | 84/21 |
| 6,600,097 | B2 * | 7/2003 | Shiiya | 84/609 |
| 6,703,549 | B1 * | 3/2004 | Nishimoto et al. | 84/609 |
| 6,737,571 | B2 * | 5/2004 | Furukawa | 84/610 |
| 6,800,799 | B2 * | 10/2004 | Fujiwara et al. | 84/645 |
| 6,949,705 | B2 * | 9/2005 | Furukawa | 84/610 |
| 7,129,408 | B2 * | 10/2006 | Uehara | 84/645 |
| 7,288,712 | B2 * | 10/2007 | Uehara | 84/645 |
| 7,375,275 | B2 * | 5/2008 | Matsuoka et al. | 84/645 |
| 2001/0007219 | A1 * | 7/2001 | Uehara et al. | 84/609 |
| 2002/0092411 | A1 * | 7/2002 | Shiiya | 84/609 |
| 2003/0101862 | A1 * | 6/2003 | Furukawa | 84/610 |
| 2003/0133700 | A1 * | 7/2003 | Uehara | 386/96 |
| 2003/0172798 | A1 * | 9/2003 | Fujiwara et al. | 84/609 |
| 2003/0177890 | A1 * | 9/2003 | Furukawa | 84/610 |
| 2004/0055444 | A1 * | 3/2004 | Ishii et al. | 84/604 |
| 2005/0056141 | A1 * | 3/2005 | Uehara | 84/645 |
| 2005/0150362 | A1 * | 7/2005 | Uehara | 84/645 |
| 2006/0027079 | A1 * | 2/2006 | Uehara | 84/609 |
| 2006/0101978 | A1 * | 5/2006 | Honeywell et al. | 84/13 |
| 2006/0273936 | A1 * | 12/2006 | Matsuoka et al. | 341/50 |
| 2007/0113728 | A1 * | 5/2007 | Weir | 84/645 |
| 2008/0019667 | A1 * | 1/2008 | Uehara | 386/96 |
| 2008/0208740 | A1 * | 8/2008 | Uehara | 705/40 |

(Continued)

FOREIGN PATENT DOCUMENTS

| | | |
|---|---|---|
| JP | 08-335079 | 12/1998 |

*Primary Examiner*—David S. Warren
(74) *Attorney, Agent, or Firm*—Morrison & Foerster LLP

(57) ABSTRACT

An electronic keyboard instrument with a key driver stores automatic performance data including a first event and first timing data and key-driving data including a second event and second timing data that precedes the first timing data for a predetermined time, and reproduces the automatic performance data and the key-driving data in parallel. An event which appears first is detected in the automatic performance data and the key-driving data when the reproduction is started. The automatic performance data and the key-driving data are reproduced rapidly until the detected event and at a normal speed after the detected event.

5 Claims, 9 Drawing Sheets

U.S. PATENT DOCUMENTS

2009/0139389 A1* 6/2009 Bowen ..... 84/636
2009/0173215 A1* 7/2009 Reynolds et al. ..... 84/612
2009/0173217 A1* 7/2009 Kim ..... 84/615

* cited by examiner

ELECTRONIC KEYBOARD INSTRUMENT HAVING A KEY DRIVER

CROSS REFERENCE TO RELATED APPLICATION

This application is based on Japanese Patent Application 2007-077196, filed on Mar. 23, 2007, the entire contents of which are incorporated herein by reference.

BACKGROUND OF THE INVENTION

A) Field of the Invention

This invention relates to an electronic keyboard instrument with a key driver, and more in detail, an electronic keyboard instrument with a musical keyboard including plurality of keys and a key driver to drive each key interlocked with reproduction of automatic performance data.

B) Description of the Related Art

Conventionally, an electronic keyboard instrument that equips a musical tone generator and a keyboard including plurality of keys, executes automatic performance by driving the musical tone generator based on the automatic performance data and drives each key interlocked with the reproduced automatic performance is well-known (for example, refer to Japanese Laid-Open Patent H08-335079).

It takes some time from providing the performance (key-driving) event to a key-driving circuit until a key is driven (to be in a condition of being pressed). When the performance event is provided to both of the key-driving circuit and the musical tone generator at the same time, generation of key movement and sound disagree, and it brings discomfort. Therefore, in the above-described electronic musical instrument, disagreement of generation of the key movement and the sound is prevented by providing the performance event to the musical tone generator after a predetermined time after providing the performance event to the key-driving circuit.

In the conventional electronic keyboard instrument with a key driver, a timing adjustment process is executed while reproducing the automatic performance data, and it is difficult to execute a so-called quick start. The "quick start" is a reproducing method in an automatic performance for reproducing a predetermined period of performance data at high speed when there is a predetermined space or an event relating to an initial setting other than a performance event (note-on and off-event) relating to sound at a beginning of the performance data and starting reproduction at a normal speed from the first performance event. For example, when there is performance data having a plurality of tracks and when a part of the tracks is used for key driving, the performance event is reproduced at high speed until the first appearing performance event of the plurality of the tracks. Then, when reproduction is executed at normal speed from that performance event, and when the performance event is used for also key driving, the performance event is provided to the key-driving circuit and to the musical tone generator after the predetermined time after providing to the key-driving circuit. However, when the performance event is not used for key driving, and when the performance event is provided to the musical tone generator after the predetermined time, reproduction start will delay for the predetermined time, and it cannot be called "quick start".

SUMMARY OF THE INVENTION

It is an object of the present invention to provide an electronic keyboard instrument with a key driver that can eliminate needless delay of reproduction start at a time of quick start and certainly drive keys for performance event to be reproduced for the first time when the keys are driven interlocked with reproduction of the automatic performance data.

According to one aspect of the present invention, there is provided an electronic keyboard instrument, comprising: a storage device that stores automatic performance data including a first event for generating a musical tone and first timing data that defines a reproduction timing of the first event, and key-driving data including a second event corresponding to the first event included in the automatic performance data and second timing data that defines a reproduction timing of the second event and precedes the first timing data for a predetermined time; a keyboard that has a plurality of keys; a key driver that drives each of the plurality of keys in accordance with the key-driving data; a reproduction device that reproduces the automatic performance data and the key-driving data in parallel; and a reproduction controller that detects an event which appears first in the automatic performance data and the key-driving data when the reproduction device starts reproduction and controls the reproduction device to reproduce the automatic performance data and the key-driving data rapidly until the detected event and to reproduce the automatic performance data and the key-driving data at a normal speed after the detected event.

According to the present invention, needless delay of starting reproduction can be eliminated even at a quick start when keys are driven in accordance with the reproduction of automatic performance data while a key corresponding to a performance event to be reproduced first can be driven certainly.

DETAILED DESCRIPTION OF THE PREFERRED EMBODIMENTS

Figure 1:
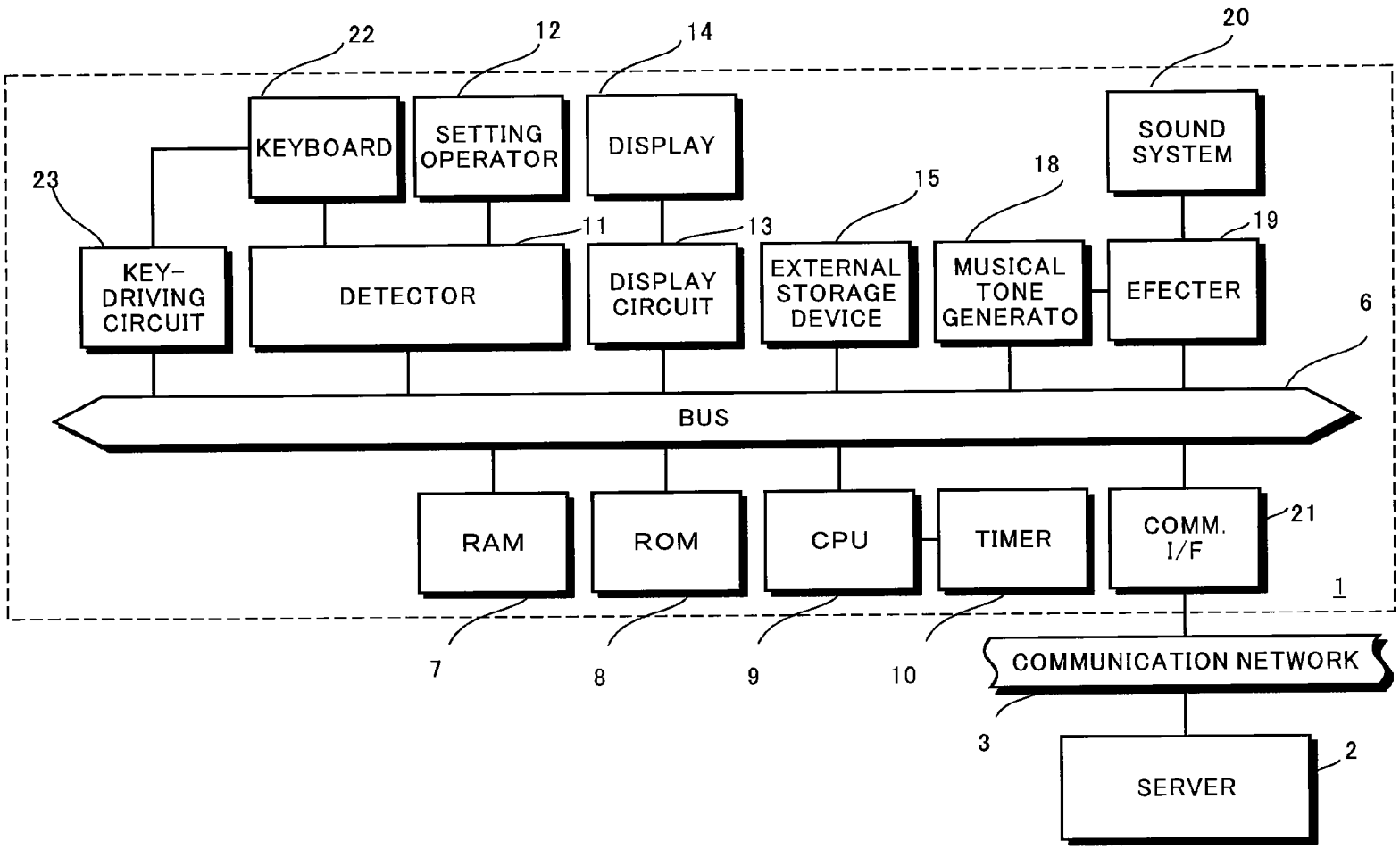
FIG. 1 is a block diagram showing a basic structure of an electronic keyboard instrument 1 according to an embodiment of the present invention.

FIG. 1 is a block diagram showing a basic structure of an electronic keyboard instrument 1 according to an embodiment of the present invention.

A RAM 7, a ROM 8, a CPU 9, a detector 11, a displaying circuit 13, an external storage device 15, a musical tone generator 18, an effecter 19, a communication interface (I/F) 21 and a key-driving circuit 23 are connected to a bus 6.

The RAM 7 has a working area of the CPU 9 that stores buffer region such as a reproduction buffer and the like, a flag, a register and various parameters.

Various parameters and controlling programs or programs for realizing the embodiment of the present invention can be stored in the ROM 8. In this case, it is not necessary to store the programs and the like in the external storage device 15 in duplicate.

The CPU 9 executes calculations and controls the electronic keyboard instrument 1 in accordance with control programs or programs for realizing the embodiment of the present invention stored in the ROM 8 or the external storage device 15. The timer 10 is connected with the CPU 9 and provides a standard clock signal and interrupt timing to the CPU 9.

A user can input, set and select various settings by using a setting operator 12 connected to the detector 11. The setting operator 12 may be any types of operators that can output signals corresponding to the user's input operations such as an alpha-numeric keyboard, a mouse, a switch, a pad, a fader, a slider, a rotary encoder, a joy-stick, a jog-shuttle and the like. Moreover, the setting operator 12 may be a software switch to be displayed on a display 14 and operated by using other operator such as a mouse and the like.

The displaying circuit 13 is connected to the display 14 and can display various kinds of information on the display 14. The user executes various kinds of input and setting operations with reference to the information displayed on this display 14. Moreover, the display 14 may be configured by connecting to an external displaying device.

The external storage device 15 is configured of at least one combination of a hard disk, the FD (flexible disk or floppy disk (trademark)), the CD (compact disk), the DVD (digital versatile disk) and storing medium such as semiconductor memory such as a flash memory and those driving devices. The storing medium may be a removed type or built-in in the electronic keyboard instrument 1.

A plurality of automatic performance data PD (FIG. 4) and driving data MD (FIG. 4) used in the embodiment of the present invention and the like can be stored in the external storage device 15, and the program for realizing each embodiment of the present invention and other program for controlling the electronic keyboard instrument 1 can be also stored. Moreover, when the program for realizing each embodiment of the present invention and other program for controlling the electronic keyboard instrument 1 are stored in the external storage device 15, it is not necessary to store them duplicately in the ROM 8. Moreover, only some of the programs may be stored in the external storage device 15 and other programs may be stored in the ROM 8.

The musical tone generator 18 generates musical tone signals corresponding to the performance data PD stored in the external storage device 15, the ROM 8 or the RAM7, or the performance signals provided from a keyboard 22 or the external device connected with the communication interface 21 and provides the generated signals to the sound system 20 via the effecter 19.

The effecter 19 adds various kinds of musical effects to the musical tone signals provided from the musical tone generator 18. A sound system 20 includes a D/A converter and a loudspeaker and converts the digital musical tone signals to analogue signals for sounding.

The keyboard 22 is an operator including a plurality of keys 220 for inputting a musical performance by a user, a key-driving system 225 (FIG. 2) corresponding to each key, and an operation start timing and a finish timing to the keys by the user are input as a key-on signal and a key-off signals at a pitch corresponding to the key operated by the user. Moreover, each key 220 of the keyboard 22 is driven by the key-driving system 225 equipped for each key in accordance with the automatic performance data PD (FIG. 4) to be reproduced in the electronic keyboard instrument 1 (for example, in accordance with the driving data MD (FIG. 4)). Moreover, structure of the keyboard 22 will be explained with reference to FIG. 2A and FIG. 2B.

Figure 4:
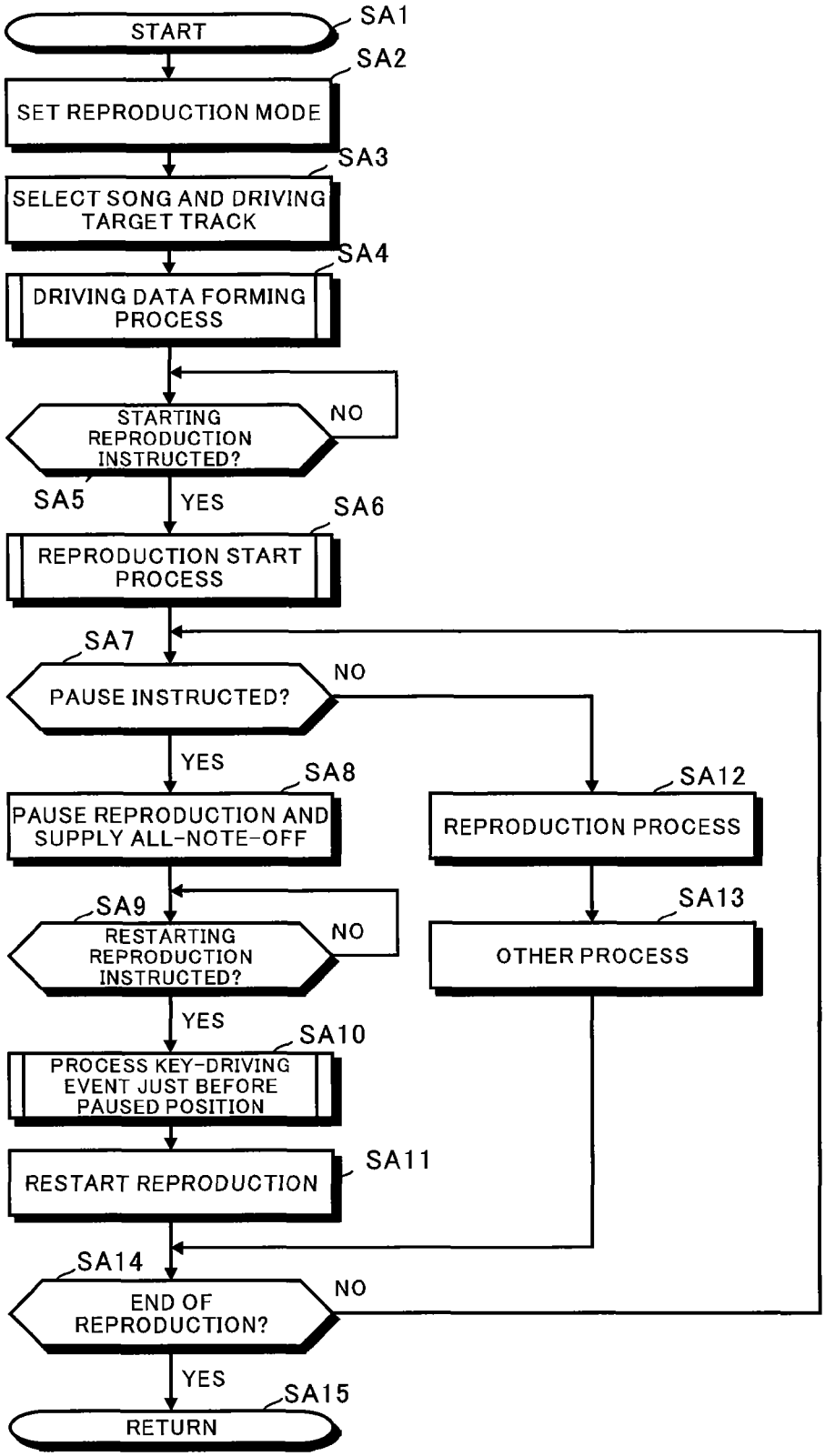
FIG. 4 is a flow chart showing an automatic performance process according to the embodiment of the present invention.

The key-driving circuit 23 controls the key-driving system 225 equipped with each key 220 corresponding to a pitch designated by the key-driving event MV at a timing designated by timing data TD included in the later-described driving data MD (FIG. 4).

The communication interface 21 is at least one of the communication interface such as a wired I/F dedicated for music such as MIDI interface, an universal short-distanced wired I/F such as a USB interface, the IEEE1394 interface and the like, an universal network I/F such as the Ethernet (trademark) and the like and an universal short-distanced wireless I/F such as a wireless LAN, the Bluetooth (trademark) and the like.

The communication I/F 21 can be connected to a communication network 3 such as a LAN (local area network) and the Internet and can be connected to a server 2 and other electronic musical instrument with each other via the communication network 3.

Figure 2A:
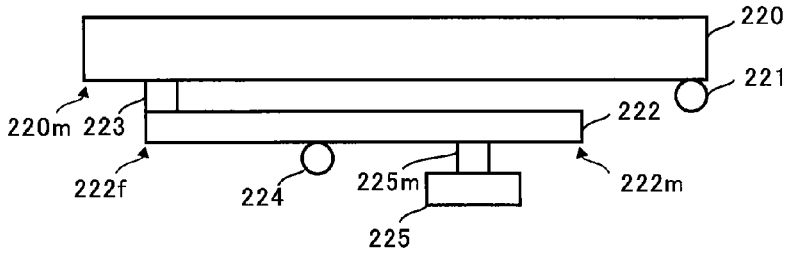
FIG. 2A and FIG. 2B are schematic diagrams showing a structure of a keyboard 22 according to the embodiment of the present invention.
Figure 2B:
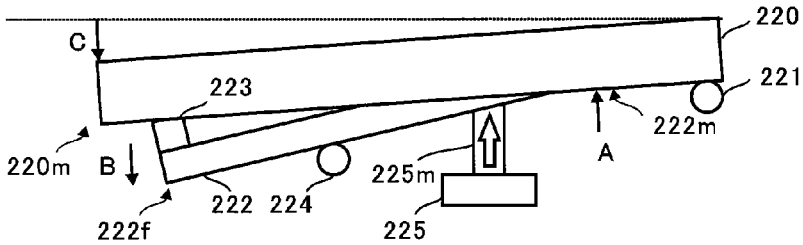

FIG. 2A and FIG. 2B are schematic diagrams showing a structure of a keyboard 22 according to the embodiment of the present invention. The diagram shows one white key 220 of a plurality of the keys 220 and a structure of a peripheral system corresponding to the white key 220, and all of the keys 220 have almost same structure except difference in shapes of the white key and the black key. FIG. 2A shows a condition of a non-operated (released) key 220 and the peripheral system. FIG. 2B shows a condition of an operated (pressed) keys 220 and the peripheral system. Moreover, arrows A to C and a white arrow in the diagram represent moving directions of the components.

Each key 220 includes, as a peripheral system, a key fulcrum 221, a hammer 222, a contacting part 223 between key and the hammer 222, a hammer fulcrum 224 and a key-driving system 225. Moreover, each key 220 includes a switch (not shown in the drawings) for detecting ON/OFF (pressing/releasing) of each key and key-pressing velocity.

When a user operates (presses) the key 220, a key free-end (tip) 220*m* of the key 220 turns in a direction C around the key fulcrum 221. Then, a hammer contacting end 222*f* of the hammer 222 that is contacted with the key 220 by the contacting part 223 around the key free-end 220*m* turns in a direction B around the hammer fulcrum 224, and the hammer free-end 222*m* turns in a direction A. At this time, the key becomes a condition shown in FIG. 2B, and a key-on signal is generated by contacting the hammer contacting end 222*f* with the switch (not shown in the diagram) for detecting key pressing velocity, etc. Thereafter, by releasing a user's finger from the key 220, the key free-end 220*m*, the hammer contacting end 222*f* and the hammer free-end 222*m* naturally turn in reversed directions as before by a weight of the hammer 222 to return to an original condition shown in FIG. 2A.

The key-driving system 225 is configured of, for example, a push-typed solenoid or a push-pull-typed solenoid. It is driven by a control signal from the key-driving circuit 23 in FIG. 1. Moreover, in this specification, driving a key in the white arrow direction in the drawing (to make it in a condition shown in FIG. 2B) is called "the forward direction drive", and driving a key in a step-back direction to make it in the original condition (a condition shown in FIG. 2A) is called "the reverse direction drive". The terms "drive" or "driving" indicates either one or both of the forward direction drive and the reverse direction drive. That is, when a drive event (key-on event) MV of the driving data MD is reproduced, a driving control signal is input (a coil of the solenoid is electrically conducted) by the key-driving circuit 23, and the driving part 225*m* is driven in the forward direction indicated by the white arrow in the drawing based on the control signal. By this driving part 225*m* pushing up the hammer free-end 222*m*, the hammer free-end 222*m* turns in the direction A, and the hammer contacting end 222*f* of the hammer 222 that is contacted with the key 220 by the contacting part 223 near the key free-end 220*m* turns in the direction B around the hammer fulcrum 224. Then, the key free-end (tip) 220*m* of the key 220 turns in the direction C around the key fulcrum 221 because the hammer contacting end 222*f* is contacted with the key 220 by the contacting part 223 near the key free-end 220*m*. As described in the above, by driving the key-driving system 225 in the forward direction, the key 220 can be turned as same as the above-described key-pressing-operation by a user, and the key 220 can be driven as if a user presses the key without a key-pressing-operation by a user.

Moreover, when a driving event (key-off event) MV of the driving data MD, all-note-off or all-sound-off is reproduced, a drive releasing control signal is input (conducted condition to the coil of the solenoid is changed or the electric current is switched to a return electric current) by the key-driving circuit 23, and the driving part 225*m* is driven to the reversed direction that is a reversed direction of the white arrow based on the control signal.

Moreover, in the above-described example, the key 220 has the hammer 222; however, the key 220 may not be equipped with the hammer 222. In that case, the key-driving system 225 is configured by a pull-typed solenoid and the like, and the key 220 may be directly driven without the hammer 222. Moreover, even if the key has the hammer 222, the key may be directly driven. Moreover, in the above-described example, the solenoid is used as the key-driving system 225; however, the key-driving system 225 may be any types of driving systems if it can quickly push up or pull down the hammer 222 in accordance with the control signal from the key-driving circuit 23.

Moreover, the key-driving system 225 is not limited to ON/OFF by conducting and interrupting electric current, but the turning angle and speed of the key 220 may be controlled based on a parameter such as a velocity and the like.

Figure 3:
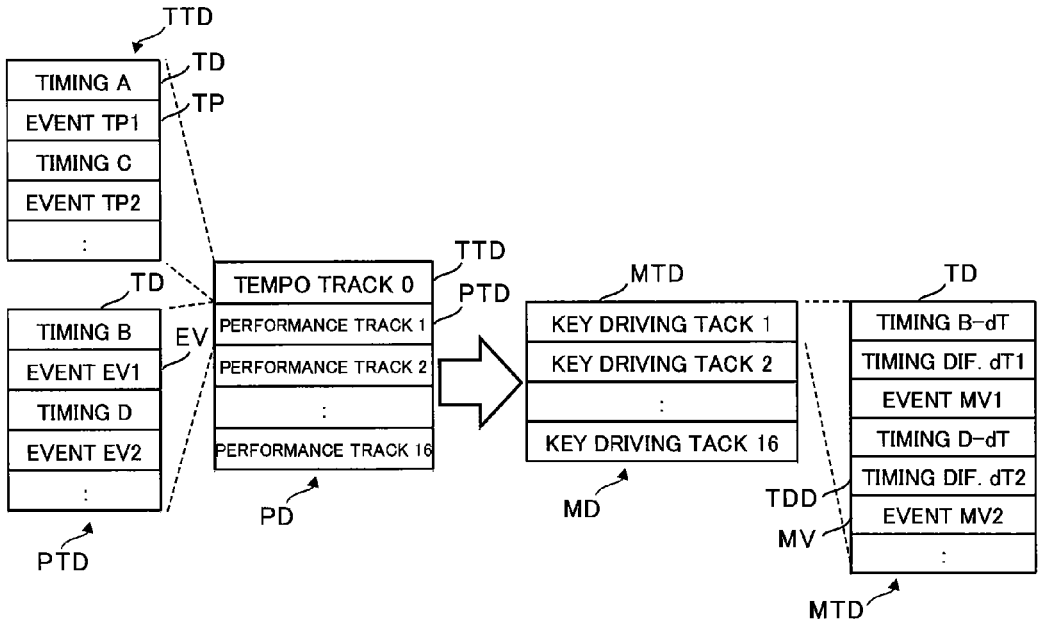
FIG. 3 is a schematic diagram showing a structure of performance data PD and driving data MD formed based on the performance data PD according to the embodiment of the present invention.

FIG. 3 is a schematic diagram showing a structure of performance data PD and driving data MD formed based on performance data PD according to the embodiment of the present invention.

The performance data PD is automatic performance data such as MIDI data, etc. A tempo track TTD (for example, a tempo track 0) and a plurality of performance tracks PTD (for example, performance tracks 1 to 16) are included in the performance data PD. Moreover, the performance data PD is stored, for example, in the external storage device 15 or the ROM8 in FIG. 1. Furthermore, the performance data PD is not only stored in the electronic keyboard instrument 1 but obtained via the communication network 3. For example, the data may be downloaded by a quasi-streaming (a downloading method for downloading MIDI data and deleting automatically after reproducing it) from distribution service of the performance data in the communication network 3 such as the Internet. Moreover, the performance data PD is stored in the external storage device 15 in FIG. 1 and in a reproduction buffer such as the RAM 7 when reproduced. The performance data PD that is temporally downloaded by quasi-streaming and the like is stored in the reproduction buffer such as the RAM 7 and the like and deleted after finishing reproduction.

The performance track PTD includes the timing data TD and various events EV to be reproduced at timings indicated by the timing data.

The timing data TD is data represented by tick (or clock) that is a quotient of a predetermined note length divided by a predetermined number (resolution). As an example, when a quarter note (crotchet) is divided by 1920, it is "resolution=1920" and a length of 1920 ticks is equivalent to a length of a quarter note. Moreover, since the tick is a quarter note divided by a resolution, a time length of the tick changes depending on a tempo. The timing data TD may be represented by an absolute timing (number of the ticks) from a predetermined position such as a beginning of the track (performance data PD) or by a relative timing (number of the Ticks) from previous event (timing data TD). In the embodiment of the present invention, the timing data TD is represented by the absolute timing from the beginning of the performance data PD.

The event EV is data to be reproduced (output to the musical tone generator 18 or the effecter 19 in FIG. 1) at a timing indicated by the timing data TD, and for example, the performance track PTD includes the events EV such as a note event, a program change, a control change (all-note-off, all-sound-off and the like), and system exclusive events. The note event may consist of distinct note-on and note-off events or be a combination of a note-on event and a gate time. In the embodiment of the present invention, each note event is recorded as a combination of the note-on event and the gate time.

The tempo track TTD consists of the timing data TD and a tempo change event TP to be reproduced at the timing indicated by the timing data TD. The tempo change event TP is for setting reproduction tempo of the performance data PD.

The driving data MD is data for key-driving to be formed based on the performance data PD at the later-described driving data forming process in FIG. 5. The driving data MD has same numbers of key-driving tracks MTD (for example, the key-driving tracks 1 to 16) as the performance data PD on which the driving data MD is based. Moreover, the key-driving tracks 1 to 16 respectively correspond to the performance tracks 1 to 16. Each key-driving track MTD includes the timing data TD, the key-driving event MV to be reproduced at timing indicated by the timing data TD and the timing difference dT. The key-driving event MV is a note event corresponding to that stored in an original performance data PD and data to be reproduced (output to a key-driving circuit 23 in FIG. 1). Moreover, a part of the control change events (all-note-off and all-sound-off) may be stored as the key-driving event MV depending on necessity. Moreover, the note event (key-driving event MV) in the key-driving track MTD may include parameters such as velocity and the like for controlling velocity of key-driving and a rotation distance (angle) of the key 220 in addition to a pitch (note number) and a gate time.

The key-driving event MV in the key-driving track MTD is formed based on the event of the corresponding performance track PTD. All contents of these events are the same but reproduction timings of both events (the event EV and the key-driving event MV) are different. The key driving takes a predetermined time (for example, approximately 50 msec) from the key-driving system 225 (FIG. 2) starts to drive (for example, from an electric current is supplied to a solenoid) until the key 220 is driven to be in a condition of being pressed. The event MV in the key-driving track MTD is reproduced at timing prior to the corresponding event EV in the performance track PTD for the above-described predetermined time.

The timing difference dT corresponds to a duration corresponding to the above-described predetermined time and is represented by "tick". Number of ticks corresponding to the predetermined time (for example, 50 msec) changes depending on the performance tempo. Therefore, a value of the timing difference dT depends on the tempo.

For example, when an event EV1 to be reproduced at a timing B in a performance track 1 is a note event, an event MV1 in a corresponding key-driving track 1 is the same note event, and its timing is a value obtained by deducting the timing difference dT from the timing B in the performance track 1 (timing B-dT).

Moreover, in the embodiment of the present invention, the key-driving tracks MTD are formed based on all performance tracks PTD included in the original performance data PD. Actually a track to be used for key driving is one or a part of the performance tracks PTD. Therefore, the performance track or tracks PTD to be used for forming the key-driving track or tracks may be arbitrarily selected by a user or automatically selected in accordance with a predetermined rule. Typically, tracks corresponding to a right-hand part and a left-hand part of a keyboard performance such as a piano are selected. However, other part can be a driving target by arbitral selection of a user.

FIG. 4 is a flow chart showing an automatic performance process according to the embodiment of the present invention. This process is, for example, booted up when an automatic performance mode of the performance data PD is selected on the electronic keyboard instrument 1 and executed by the CPU 9 in FIG. 1.

At Step SA1, the automatic performance process starts. At Step SA2, setting of a reproduction mode is executed. The setting of a reproduction mode include, for example, setting a selection of (a start mode) from normal start and quick start and setting ON/OFF (key-driving mode) of the key-driving, and this setting or settings is/are stored as a flag or flags in the RAM 7 in FIG. 1.

At Step SA3, the performance data PD to be reproduced in this automatic performance process is selected (song selection), and a driving target (the performance track PTD corresponding to the driving track MTD transmitted to the key-driving circuit 23) is selected. The performance data PD is not only selected from the performance data PD stored in the electronic keyboard instrument 1 but may be selected from the performance data PD distributed by a distribution service on the Internet and the like. Moreover, as for selection of the driving track, a user may select one or a plurality of tracks by operating the operator 12 (FIG. 1), or the selection of the driving track may be automatically executed in accordance with a predetermined rule that has been determined in advance. For example, the first track (track 1) and the second track (track 2) are respectively defined as a right-hand part and a left-hand part and are automatically selected as the driving targets.

Figure 5:
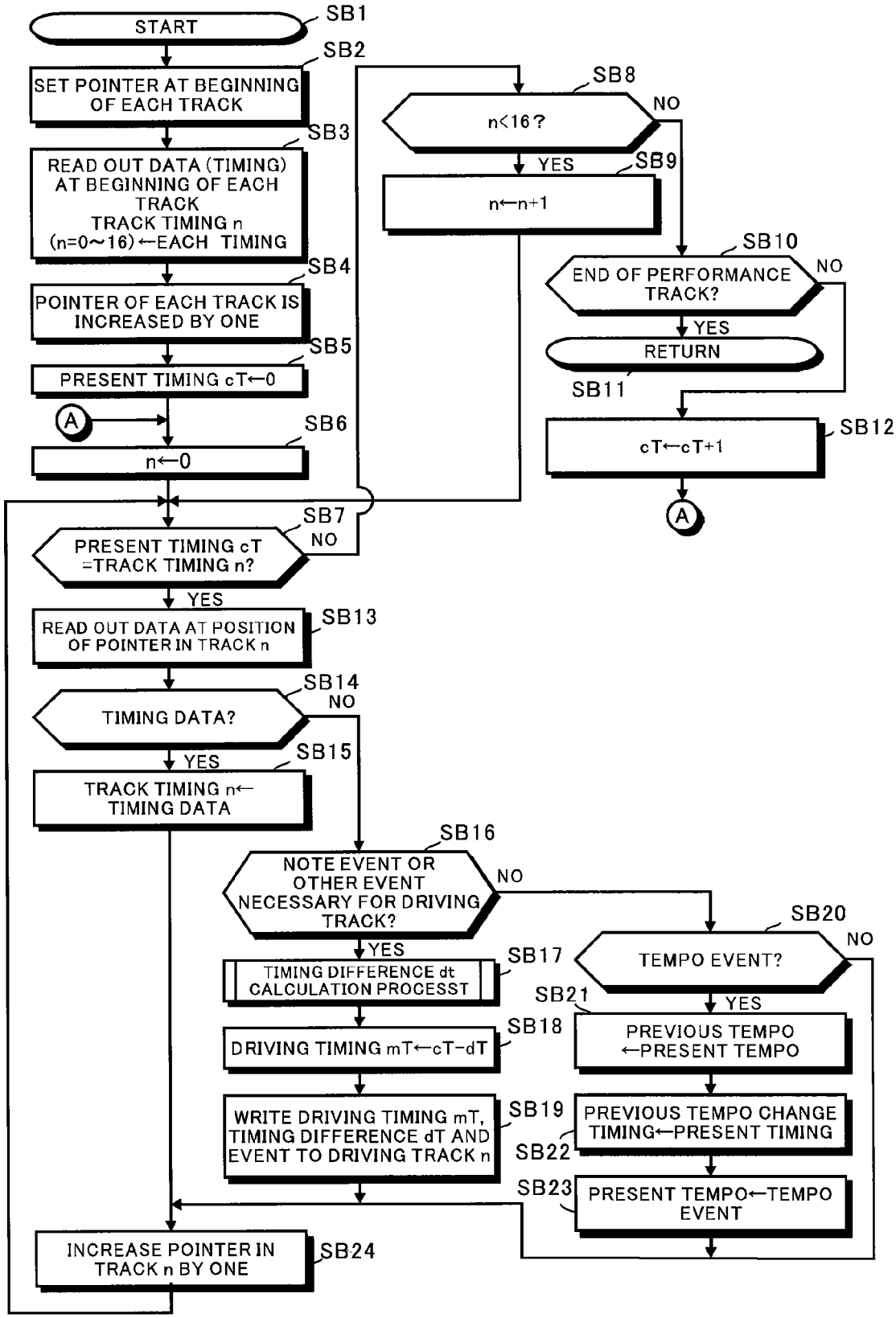
FIG. 5 is a flow chart showing a driving data forming process that is executed at Step SA4 in FIG. 4.

At Step SA4, the later-described driving data forming process in FIG. 5 is executed. At this step, the driving data MD is formed based on the performance data selected at Step SA3.

At Step SA5, it is detected whether or not starting reproduction is instructed by a user's operation of the operator 12. When the instruction of starting reproduction is detected, the process proceeds to Step SA6 as indicated with an arrow "YES". When the instruction of starting reproduction is not detected, the process at Step SA5 is repeated as indicated with an arrow "NO" to wait for the instruction of starting reproduction.

Figure 8:
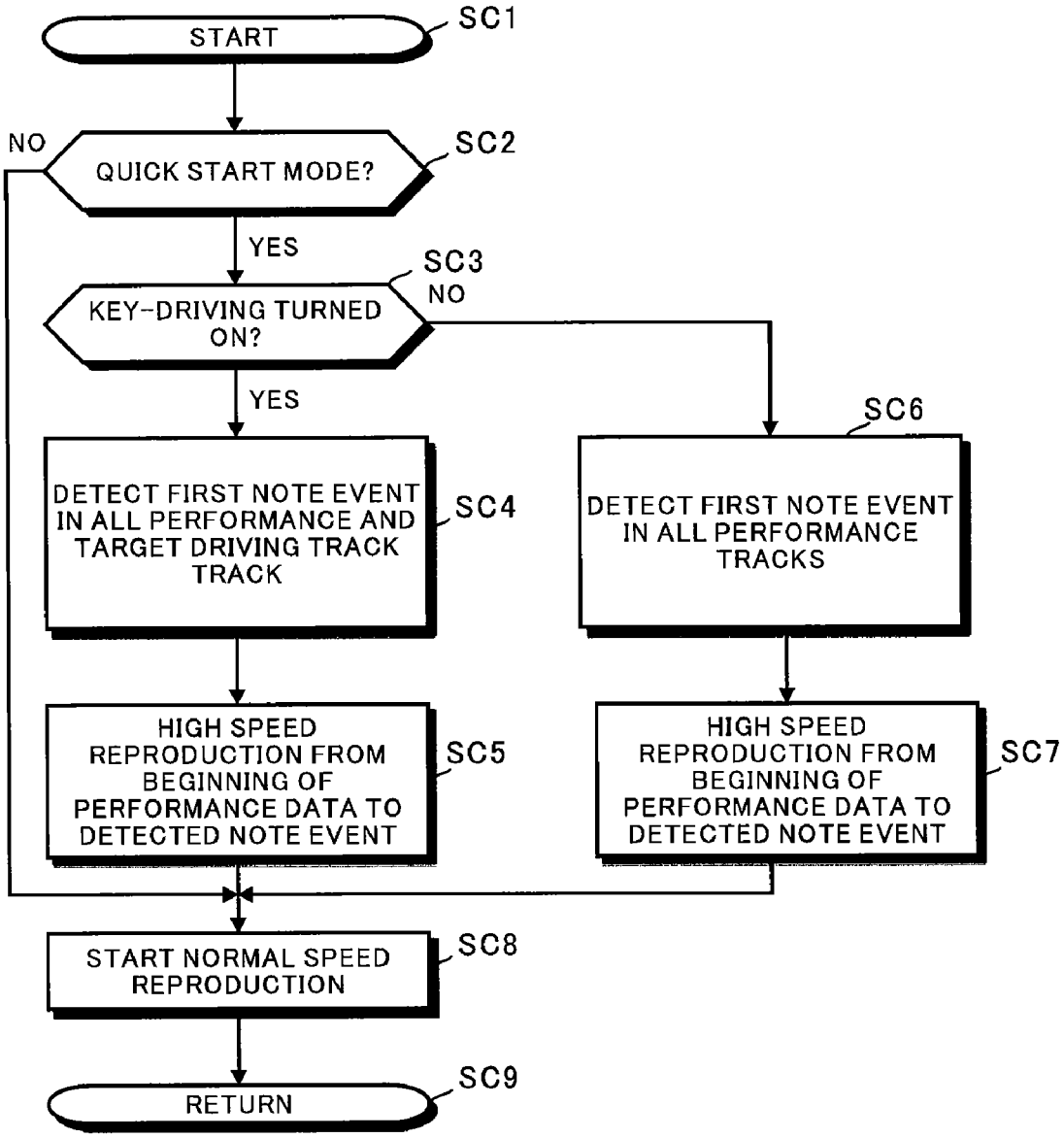
FIG. 8 is a flow chart showing a reproduction starting process that is executed at Step SA6 in FIG. 4.

At Step SA6, a reproduction start process described later in FIG. 8 is executed. In the reproduction start process, reproduction of the performance data PD selected at SA3 starts in accordance with the setting of the normal start or the quick start on the reproduction modes set at Step SA2. Then, the process proceeds to Step SA7.

At Step SA7, it is judged whether or not pause of reproduction is instructed by the user by operating the operator 12. When pause is instructed, the process proceeds to Step SA8 as indicated with an arrow "YES". When pause is not instructed, the process proceeds to Step SA12 as indicated with an arrow "NO".

At Step SA8, reproduction of the performance data PD and the driving data MD pauses, and all-note-off is provided to the key-driving circuit 23 and the musical tone generator 18. By that, musical tone generation based on the performance data PD by the musical tone generator 18 is terminated, and the key-driving system 225 returns to the original condition (releasing key state) as shown in FIG. 2A.

At Step SA9, it is judged whether or not the user instructs restarting reproduction by using the operator 12. When the user instructs restarting reproduction, the process proceeds to Step SA10. When the user does not instruct restarting reproduction, the process of Step SA9 is repeated to wait until the user instructs restarting reproduction.

At Step SA10, a process for processing the key-driving event just before paused position is executed. Details of this process will be describe with reference to FIG. 10. This process is for certainly reproducing the key-driving event MV when the key-driving event MV is positioned before the paused position and the performance event EV corresponding to the key-driving event MV is positioned after the position paused at Step SA8. Thereafter, the process proceeds to Step SA11 to restart reproduction. The restarting reproduction here is to release the paused condition at Step SA8. Then, the process proceeds to Step SA14.

At Step SA12, reproduction process is executed. In this reproduction process, the key-driving track MTD and the performance track PTD are reproduced in parallel. Moreover, when plurality of the key-driving tracks MTD and plurality of the performance tracks PTD are selected, all the tracks are reproduced in parallel. Moreover, reproduction at this step is to drive the key-driving system 225 and to drive the keys 220 by reading out the note event MV (and other event depending on necessity) from the key-driving track MTD that is the driving target to be provided to the key-driving circuit 23. Moreover, the note event and other event are provided from the performance PTD to the musical tone generator 18 and the effecter 19 to sound musical tones corresponding to the performance data PD from the sound system 20 and the like.

Moreover, in the reproduction process at Step SA12, it is not necessary to execute the timing adjustment between the key-driving note event and the performance note event as in the conventional technique, and the events are reproduced by simply reproducing both data in parallel at their reproducing timings, and so the reproduction process can be executed very simply.

At Step SA13, other process (or processes) is/are executed. At this step, instructions such as setting change and the like relating to the automatic performance by operating the operator 12 by the user are detected, and processes based on the instructions such as the detected setting change and the like are executed. More in detail, the instructions may be change of the driving target track, switching ON/OFF of the key-driving and the like. When the driving target track is changed, the driving target track to be reproduced at Step SA 12 that may be executed after executing the process at Step SA13 will be changed. When the key-driving is turned off, reproduction of the driving track will stop at Step SA12 to be executed after this step. When the key-driving is turned on, reproduction of the driving track will start at Step SA12 to be executed after this step. Moreover, tempo setting can be changed. When the tempo setting is changed, the driving data forming process at Step SA4 is executed once again. Moreover, when the tempo is changed, the timing difference dT in the driving data MD may be changed by being multiplied with the change ratio of the tempo instead of executing the driving data forming process at Step SA4 once again, and the timing of each driving event MV in the driving data MD may be changed. Then, the process proceeds to Step SA14.

At Step SA14, it is judged whether or not the user instructs termination of reproduction by operating the operator 12 and whether or not the reproduction has been finished by reproducing the performance data PD to the end. When the reproduction finishes, that is, when the instruction of terminating the reproduction is detected or when all the performance data PD has been reproduced to the end, the process proceeds to Step SA15 as indicated with an arrow "YES" to finish the automatic performance process. When the reproduction does not finish, the process returns to Step SA7 as indicated with an arrow "NO" to repeat the process after that process.

FIG. 5 is a flow chart showing a driving data forming process that is executed at Step SA4 in FIG. 4. In this process, the driving data MD is formed in advance based on the performance data PD before starting reproduction of the performance data PD selected at Step SA3 in FIG. 4.

At Step SB1, a driving data forming process starts. At Step SB2, pointers of the tempo track TTD included in the performance data PD selected at Step SA3 in FIG. 4 and all the performance tracks PTD (hereinafter, the whole tracks are collectively called the process target track in this driving data forming process) are set to the beginning of the tracks.

At Step SB3, the beginning data (the beginning timing data TD) of the process target track is read out, and timing data read out from track n is set to a corresponding track timing register n (n=0 to 16).

At Step SB4, the pointer of each process target track is increased by one. At Step SB5, "0" is set for the present timing register cT to initialize. At Step SB6, "0" is set for the track number register n.

At Step SB7, a timing value (tick) that is presently set in the timing register cT is compared with a timing value (tick) that is set in the track timing register n. When the timing value (tick) in the present timing register cT and the timing value (Tick) in the track timing register n are same, the process proceeds to Step SB13 as indicated with an arrow "YES". When the timing values are different, the process proceeds to Step SB8 as indicated with an arrow "NO".

At Step SB8, it is judged whether or not the value set in the track number register n is less than "16". Moreover, in the embodiment of the present invention, it is supposed to have one tempo track "0" and 16 performance tracks 1-16. When the current value of the track number register n is over "16", it is considered that the process for all the tracks at the present timing cT finished; therefore, it is judged whether or not the value in the track number register n is less than "16". Moreover, this value is made to be same as number of all the performance tracks included in the performance data PD. For example, when number of the tracks (including the tempo track) in the performance data PD is "9", the value is set to "8". When the current value of the track number register n is less than "16", the process proceeds to Step SB9 as indicated with an arrow "YES". When the current value of the track number register n is not less than "16", the process proceeds to Step SB10 as indicated with an arrow "NO".

At Step SB9, "1" is added on the value in the track number register n (n=n+1), and the process proceeds to Step SB7. By that, the process target in the process after the Step SB7 to be executed after this step will be a track having the next track number.

At Step SB10, it is judged whether or not the pointer reaches to the end of the process target track. When the pointer reached to the end, the process proceeds to Step SB11 as indicated with an arrow "YES" and thereafter the process proceeds to Step SA5 in FIG. 4. When the pointer does not reach to the end, the process proceeds to Step SB12 as indicated with an arrow "NO". Then, "1" is added to the value of the present timing register cT (the present timing cT is added with 1 tick) and then the process proceeds to Step SB6.

At Step SB13, the data at the pointer position of the track of which track number is n (track n) is read out. At Step SB14, it is judged whether or not the read data is the timing data TD. When it is the timing data TD, the process proceeds to Step SB15 as indicated with an arrow "YES". When it is other data (event data), the process proceeds to Step SB16 as indicated with an arrow "NO".

At Step SB15, the value (tick) of the timing data TD read out at Step SB13 is set in the track timing register n. Then, the process proceeds to Step SB24.

At Step SB16, it is judged whether or not the data read out at Step SB13 is a note event EV or other event EV (all-note-off, all-sound-off and the like) that is necessary for the key-driving track. When it is the note event EV or the other event EV that is necessary for the key-driving track, the process proceeds to Step SB17 as indicated with an arrow "YES". When it is not the note event EV or the other event EV that is necessary for the key-driving track, the process proceeds to Step SB20 as indicated with an arrow "NO".

Figure 6:
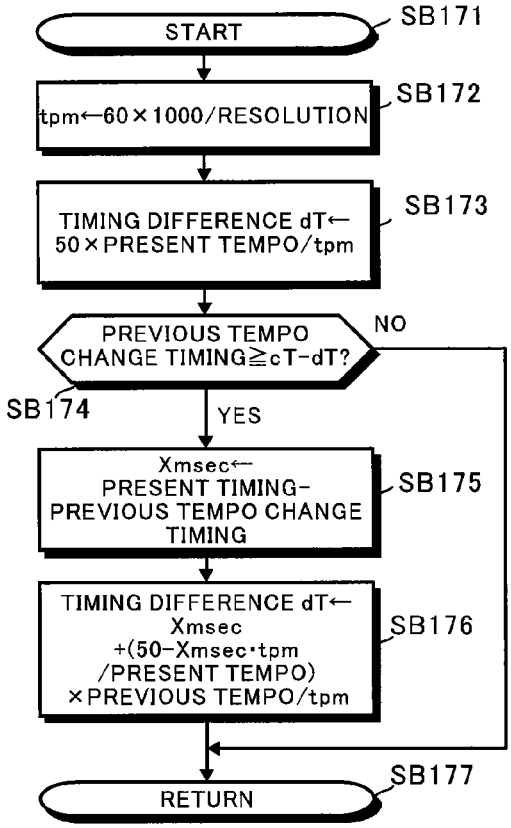
FIG. 6 is a flow chart showing a calculation process of a timing difference dT that is executed at Step SB17 in FIG. 5.

At Step SB17, a calculation process of the timing difference dT described later in FIG. 6 is executed. As described in the above, the timing difference dT is timing difference for reproducing the key-driving event MV prior to reproduction of the corresponding performance event (note event) EV for approximately a predetermined time (50 msec). Since it varies depending on the current set tempo and the tempo change timing, the timing difference dT is calculated at this process. Then, the process proceeds to Step SB18.

At Step SB18, the driving timing mT that is the reproduction timing of the key-driving event MV corresponding to the note event red out at Step SB17 is calculated by subtracting the value of the timing difference dT calculated at Step SB17 from the value of the present timing register cT.

At Step SB19, it is defined that the driving timing mT calculated at Step SB18 is the timing data TD and the event data EV read out at Step SB13 is the driving event MV, and they are written into the driving track n with the timing difference dT calculated at Step SB17. Then, the process proceeds to Step SB24. Moreover, the event data EV read out at Step SB13 may be used as the driving event MV with keeping the same contents, or it may be used as the driving event MV by using only the necessary parameter such as pitch (note number), gate time and the like.

At Step SB20, it is judged whether or not the event data read out at Step SB13 is a tempo event TP. When it is a tempo event TP, the process proceeds to Step SB21 as indicated with an arrow "YES". When it is other event (for example, system exclusive, program change and the like), the process proceeds to Step SB24 as indicated with an arrow "NO" because it does not relate to the driving data.

At Step SB21, the current set tempo (that is, a current value in the tempo register) is set in the previous tempo register. Moreover, it is defined that the tempo set by a user before starting this key driving data forming process or an initial set value in the electronic keyboard instrument 1 with a key driver has been set to the present tempo register.

At Step SB22, the value of the present timing register cT is set to the previous tempo change timing register. At Step SB23, the value of the tempo event TP that is read out at Step at SB13 is set to the present tempo register. Then, the process proceeds to Step SB24.

At Step SB24, the pointer of the track n is increased by one. Then, the process returns to Step SB7 to repeat the processes after that.

As described in the above, in the embodiment of the present invention, before the reproduction process of the performance data PD to be executed after Step SA6, the key-driving data MD having timing data adjusted in advance is formed from the performance data PD at Step SA4 in FIG. 4. Therefore, in the reproduction process after Step SA6, it is not necessary to adjust timing between the performance event and the key-driving event. Therefore, it can be prevented that the reproduction process becomes complicated, and an electronic keyboard instrument with a key driver can be developed and manufactured without obtaining the reproduction process that is adopted in the conventional electronic musical instrument.

FIG. 6 is a flow chart showing a calculation process of a timing difference dT that is executed at Step SB17 in FIG. 5.

Figure 7:
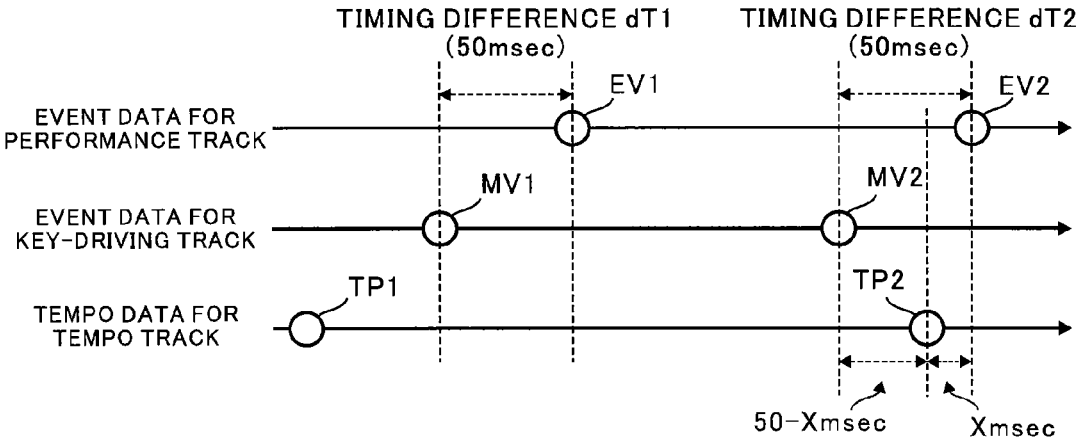
FIG. 7 is a schematic view for explaining the calculation process of the timing difference dT shown in FIG. 6.

FIG. 7 is a schematic view for explaining the calculation process of the timing difference dT shown in FIG. 6.

The timing difference dT is a value obtained by converting a predetermined time (50 msec in this embodiment) from starting of the key-driving system 225 (FIG. 2) until the key 220 actually becomes a state of being pressed to a timing value (number of ticks). Number of ticks for the predetermined time (50 msec) varies in accordance with the performance tempo.

At Step SB171, a timing difference dT calculation process starts, and a value calculated by an equation "60 multiplied by 1000 divided by current set resolution (60*1000/current set resolution)" is set in a register tpm. Moreover, since the resolution in the embodiment of the present invention is "1920", this value will be "60*1000/1920=31.25".

At Step SB173, the timing difference dt is calculated by an equation "the predetermined time (50 msec in the embodiment of the present invention) multiplied by the value in the present tempo register divided by the value in the register tpm (50·current tempo/tpm)". By that, number of ticks for the predetermined time in a single tempo can be calculated. For example, when the resolution is "1920", the predetermined time is "50 msec" and the present tempo is "120", the value (number of ticks corresponding to the predetermined time) will be "50·120/31.25"; therefore, the timing difference dt will be "192ticks".

At Step SB174, it is judged whether or not the value of the previous tempo change register set at Step SB22 in FIG. 5 is over the value obtained by subtracting the timing difference dT calculated at Step SB173 from the present timing register cT (cT-dT).

At Step SB174, when the value of the previous tempo change register is less than the value "cT-dT", the key-driving event MV1 corresponding to the performance event EV1 shown in FIG. 7 is positioned after the previous tempo change event TP1; therefore, it is obvious that there is no tempo change between the performance event EV1 and the key-driving event MV1. Therefore, in this case, the process proceeds to Step SB177 as indicated with an arrow "NO" and the timing difference calculated at Step SB173 is used without any change. Then, the process returns to Step SB18 in FIG. 5.

At Step SB174, when the value of the previous tempo change register is not less than the value "cT-dT", the previous tempo change event TP2 is between the performance event EV2 shown in FIG. 7 and the corresponding key-driving event MV2; therefore, it is necessary that the timing (number of ticks) corresponding to the predetermined time (50 msec) between the event MV2 and the event EV2 is recalculated. Therefore, in this case, the process proceeds to Step SB175 as indicated with an arrow "YES", and the timing difference dT is recalculated based on the two tempo values before and after being changed.

At Step SB175, a value obtained by subtracting the value in the previous tempo change register set at Step SB22 in FIG. 5 from the value in the present register cT is set to the register Xmsec. By that, the timing (number of ticks) of Xmsec shown in FIG. 7 is calculated.

At Step SB176, the timing difference dT is calculated by an equation "Xmsec+(50−Xmsec*tpm/present tempo register value)*previous tempo register value/tpm". More in detail, for example, when the resolution is "1920", the predetermined time is "50 msec" and the previous tempo (TP1) is "120", the previous tempo (TP2) is "100"and the timing difference Xmsec between the event TP2 and the EV2 in FIG. 7 is "100 ticks", the timing difference dT will be "172 ticks" (100+(50−100*31.25/100)*120/31.25). Then, the process proceeds to Step SB 177 to return to Step SB18 in FIG. 5.

By calculating the timing difference dT as described in the above, the timing difference dT updated with the set tempo can be set. Moreover, the timing difference dT of number of ticks corresponding to the predetermined time can be set between the driving event MV and the performance event EV even if the tempo has been changed during the predetermined time (50 msec) between the driving event MV and the performance event EV.

FIG. 8 is a flow chart showing a reproduction starting process that is executed at Step SA6 in FIG. 4. In the reproduction start process, reproduction of the selected performance data PD selected at Step SA3 starts in accordance with the normal start setting or the quick start setting on the reproduction modes, one of which has been set at Step SA2 in FIG. 4.

At Step SC1, the reproduction start process starts, and it is judged whether or not the reproduction mode (start mode) is quick start mode. This is judged with reference to the flag of the reproduction mode (start mode) set at Step SA2 in FIG. 4. When the reproduction mode (start mode) is on the quick start mode, the process proceeds to Step SC3 as indicated with an arrow "YES". When the reproduction mode is on the normal start, the process proceeds to Step SC7 as indicated with an arrow "NO", and reproduction starts at normal speed.

At Step SC3, it is judged whether or not the key-driving is turned on. This is judged with reference to the flag of the reproduction mode (key-driving mode) set at Step SA2 in FIG. 4. When the reproduction mode is on the key-driving mode (the key-driving is turned on), the process proceeds to Step SC4 as indicated with an arrow "YES". When the reproduction mode is not on the key-driving mode (the key-driving is turned off), the process proceeds to Step SC6 as indicated with an arrow "NO".

At Step SC4, the note event (performance event EV or the driving event MV) that appears first from the beginning of the data in all the performance tracks PTD of the performance data PD selected at SA3 in FIG. 4 and in the driving track MTD corresponding to the performance track PTD selected as the driving target in the key-driving data MD is detected. Thereafter, the process proceeds to Step SC5.

At Step SC5, all the performance tracks PTD of the performance data PD selected at SA3 in FIG. 4 and in the driving track MTD corresponding to the performance track PTD selected as the driving target in the key-driving data MD are reproduced from the beginning data to the note event detected at Step SC4 at high speed. Then, the process proceeds to Step SC8.

Moreover, events, etc. for executing initializing are stored in the normal performance data PD from the beginning of the data to 1 or 2 measure(s). The high speed reproduction according to the embodiment of the present invention is to reproduce those events at as high speed as possible regardless of the reproduction timing of the data for the 1 or 2 measure (s).

For example, in the electronic keyboard instrument 1 with a key driver, at least, events of 17 tracks including the tempo tracks can be read out and reproduced in one timing (1 tick). Moreover, plurality of the events in one track can be reproduced in one timing (1 tick). When the resolution is 1920 at this high speed reproduction, one or plurality of event(s) can be reproduced in 1/1920 of length of a quarter note by a simple calculation. In other words, over 1920 events can be reproduced at high speed for a time length of a quarter note.

At Step SC6, the note event (performance event EV) that appears first from the beginning of the data in all the performance tracks PTD of the performance track PD selected at SA3 in FIG. 4 is detected. Since the key driving is being turned off, it is not necessary to search in the key-driving data MD at this Step SC5. Thereafter, the process proceeds to Step SC7.

At Step SC7, all the performance tracks PTD of the performance data PD selected at Step SA3 in FIG. 4 are reproduced at high speed from the beginning of the data to the note event detected at Step SC6. Then the process proceeds to Step SC8.

At Step SC8, reproduction starts at normal speed. Reproduction at normal speed is reproduction according to the set tempo. Then, the process proceeds to Step SC9 to finish the reproduction start process.

Figure 9A:
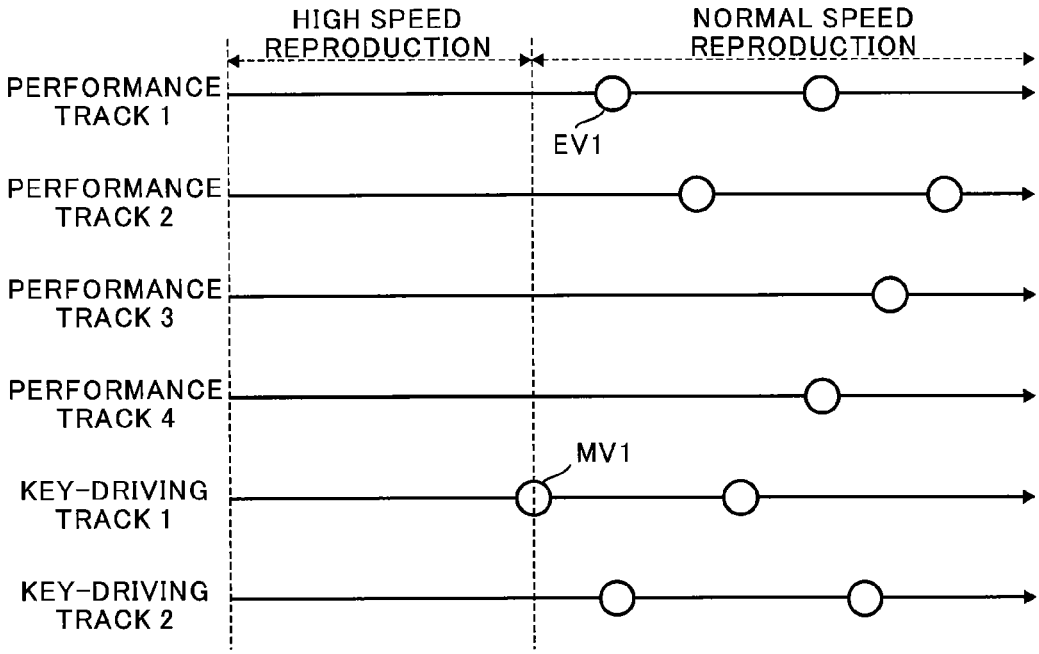
FIG. 9A and FIG. 9B are schematic diagrams for explaining the reproduction starting process shown in FIG. 8.
Figure 9B:
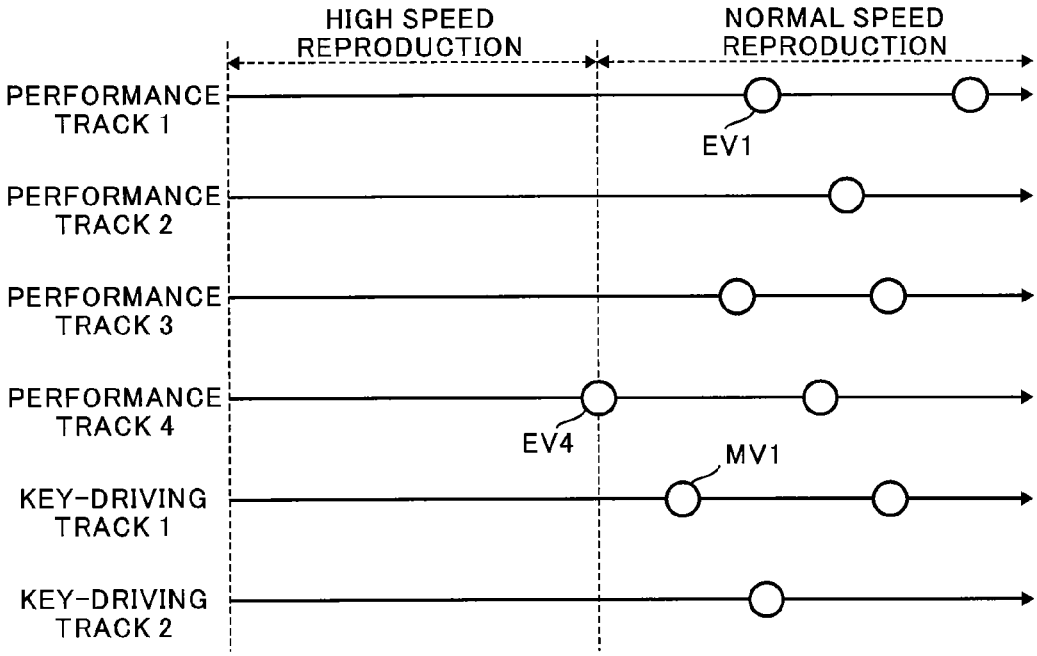

FIG. 9A and FIG. 9B are schematic diagrams for explaining the reproduction starting process shown in FIG. 8.

For example, as shown in FIG. 9A, the performance tracks 1 to 4 in the performance data PD are selected as reproduction targets. The performance tracks 1 and 2 are selected as the key-driving targets, and the driving tracks 1 and 2 corresponding to those driving target tracks are reproduced. In that case, when the key driving is turned on, the driving event MV1 is detected at Step SC4 because the first note event of the performance tracks 1 to 4 and the driving tracks 1 and 2 are detected at Step SC4. Then, events up to the driving event MV1 is reproduced at high speed at Step SC5, as for the events after that, reproduction is started at normal speed at Step SC8. Moreover, when the key-driving is turned off, the performance event EV1 is detected at Step SC6 because only the performance tracks 1 to 4 will be the detecting targets of the first note event. Then, the events up to the event EV1 are reproduced at high speed at Step SC7, as for the events after that, reproduction is started at normal speed at Step SC8.

Moreover, for example, as shown in FIG. 9B, the performance tracks 1 to 4 in the performance data PD are selected as the reproduction targets, and the performance tracks 1 and 2 are selected as the key-driving targets. Then, the driving tracks 1 and 2 corresponding to those driving target tracks are reproduced. In the performance data shown in FIG. 9B, events up to the performance event EV4 are constantly reproduced at high speed regardless of ON/OFF of the key driving because the performance event EV4 is the first note event in all the performance tracks and the driving tracks. Moreover, when the performance track 4 is selected as the driving target track, the event up to the driving event are reproduced at high speed because the driving event corresponding to the performance event EV4 will be a note event to be reproduced.

As described in the above, the key-driving data MD of which timing is adjusted in advance is generated based on the performance data PD at Step SA4 in FIG. 4 before the reproduction process of the performance data PD to be executed at Step SA6 and after that. Therefore, at the reproduction process from Step SA6, it is not necessary to adjust timing between the performance event and the key driving event. Therefore, quick start process can be easily executed because both key-driving data MD and the performance data PD are searched to detect the first note event, and only the events up to the detected note event are reproduced at high speed even if quick start is executed when the key-driving is turned on.

Moreover, since the key-driving data MD is not generated in advance in the conventional key-driving method, the timing is adjusted after detecting the first note event in the performance data, and reproduction timing of the key-driving note event corresponding to the detected performance note event is calculated, and the reproduction is performed at a high speed up to the calculated timing of the key-driving note event; therefore, the process that has to be executed when the quick start is instructed is complicated.

Moreover, according to the embodiment of the present invention with the above-described structure, a key of the keyboard can be certainly driven from the first performance event. Moreover, reproduction can be started quickly even if the first performance event is not used for the key-driving.

Figure 10:
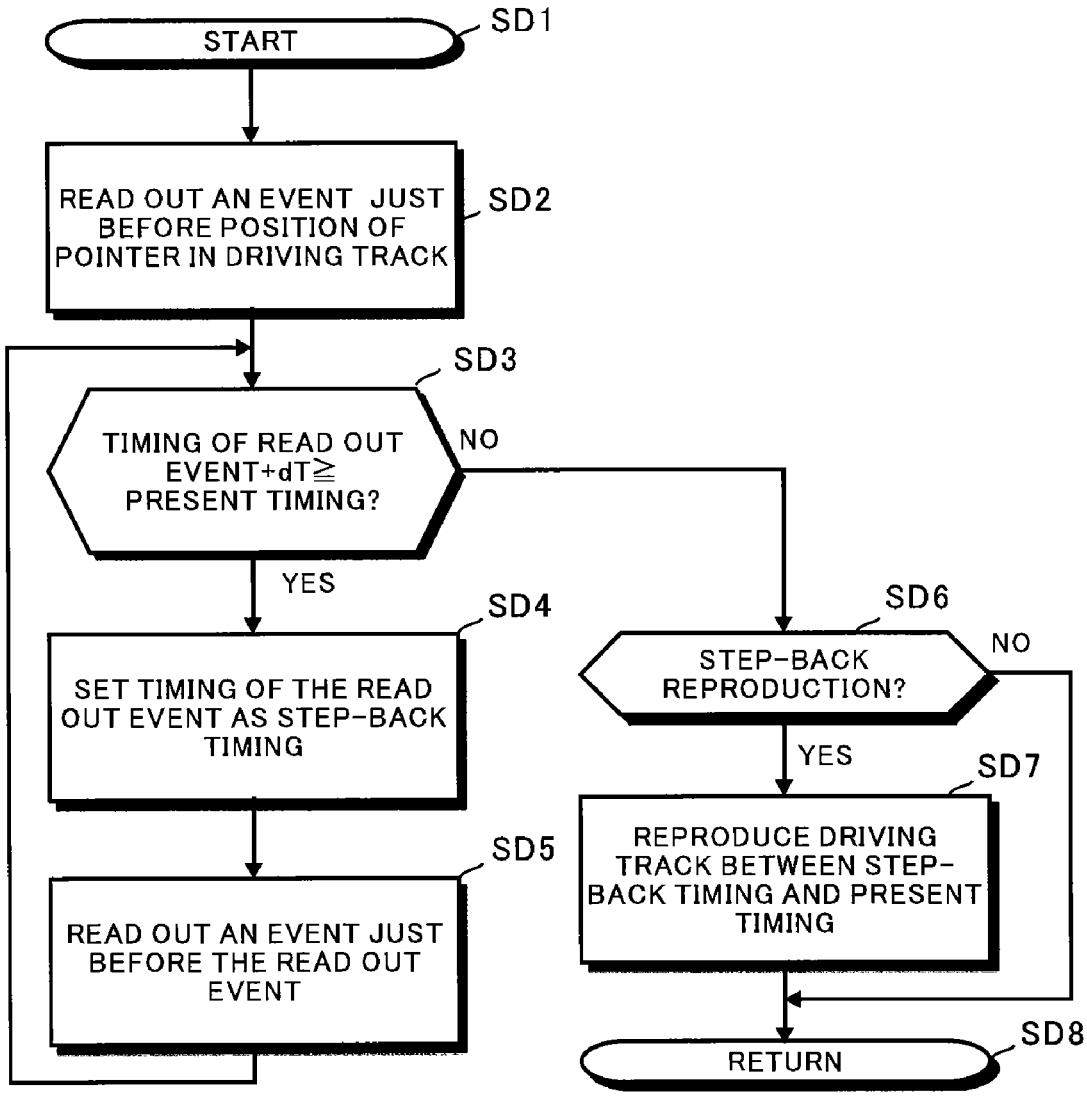
FIG. 10 is a flow chart showing the process executed at Step SA10 in FIG. 4 for processing the key-driving event just before paused.

FIG. 10 is a flow chart showing the process executed at Step SA10 in FIG. 4 for processing the key-driving event just before paused position. This process is for certainly reproducing the key-driving event MV positioned (detected) after the position paused at Step SA8 in FIG. 4 when the corresponding performance event EV is positioned (detected) before the paused position.

The process for processing the key-driving event just before paused position is started at Step SD1. At Step SD2, the driving event MV just before the pointer position of the driving track MTD corresponding to the performance track PTD selected as the driving target from the performance data PD selected at SA3 in FIG. 4 (hereinafter, just called the target driving track MTD) is read out. Moreover, when there is a plurality of the target driving tracks MTD, the process from this Step SD2 to the later-described Step SD6 is executed for each target driving track MTD.

At Step SD3, it is judged whether or not a value of timing of event MV read at Step SD2 or Step SD5 added with the timing difference dT is not less than the present timing cT. When the value added with the timing difference dT is not less than the present timing cT, the performance event EV corresponding to the event MV read out at Step SD2 or Step SD5 exists after the present timing cT. Therefore, if the reproduction is started from the present timing cT, the key-driving event MV is not reproduced as for the performance event EV corresponding to the read event MV, and so a key is not driven. In this case, the process proceeds to Step SD4 as indicated with an arrow "YES" in order to change starting timing of the reproduction, and the event MV read out at Step SD2 or Step SD5 is set to a step-back timing register. Thereafter, the process proceeds to Step SD5. When the event MV read out at Step SD5 is set to the step-back timing register, the step-back timing register is overwritten.

When the value of the timing of the event MV added with the timing difference dT is read out at Step SD2 or Step SD5 is less than the present timing cT, there will be no problem to reproduce without changing the starting timing, and the process proceeds to Step SD6 as indicated with an arrow "NO".

At Step SD5, the event just before the event MV read out at Step SD2 is read out. This is a process for repeatedly confirming that a value of the timing of the read event MV added with the timing difference dT becomes less than the present timing because the driving event MV corresponding to the performance event EV to be reproduced after the present timing cT is not limited to the event MV that is read out at Step SD2. Therefore, the process returns to Step SD3 after reading out the event MV, and it is judged whether or not the value of the timing of the event MV read out at Step SD5 added with the timing difference dT is not less than the present timing cT.

At Step SD6, it is judged whether or not the step-back reproduction is necessary. It is judged by checking whether or not the step-back timing (timing of the event MV read out at Step SD2 or Step SD5) is set to the step-back timing register set at Step SD4. When the step-back timing has been set, the process proceeds to Step SD7 as indicated with an arrow "YES" because the step-back reproduction is necessary. When the step-back timing is not set, the process proceeds to Step SD8 as indicated with an arrow "NO" to return to Step SA11 in FIG. 4 because the step-back reproduction is not necessary.

At Step SD7, only the target driving track MTD between the timing set in the step-back timing register and the present timing cT is reproduced. Thereafter, the process proceeds to Step SD8 to return to SA11 in FIG. 4. As described in the above, the driving event MV before the present timing cT and corresponding to the performance event EV after the present timing cT to be reproduced at Step SA11 in FIG. 4 can be selectively reproduced by reproducing only the target driving track MTD. Therefore, a key of the keyboard can be certainly driven as for the performance event EV even if the driving event MV corresponding to the performance event EV to be reproduced after the present timing cT is positioned before the present timing cT.

According to the process for processing the key-driving event just before paused position in the embodiment of the present invention as described in the above, it is judged whether or not a key-driving event MV corresponding to a performance event EV to be reproduced after the paused position exists before the paused position, and a key is driven in accordance with the key-driving event MV when it has been found before the paused position; therefore, the key can be certainly driven from the first performance event EV after restarting the reproduction. Moreover, when the corresponding key-driving event MV has not been found before the paused position, the reproduction is instantly restarted from the paused position; therefore, needless delay can be avoided.

Figure 11A:
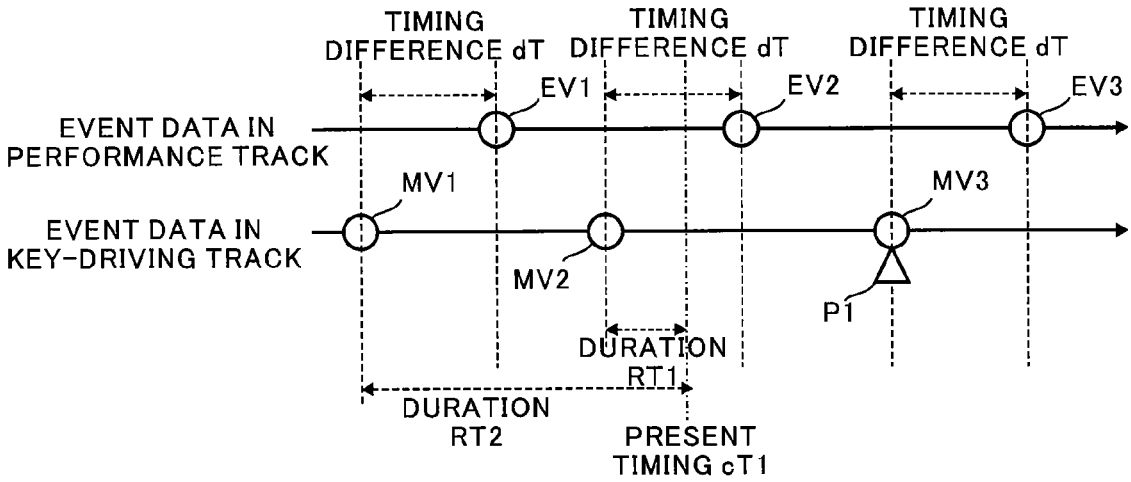
FIG. 11A and FIG. 11B are schematic diagrams for explaining the key-driving event process just before pausing shown in FIG. 10.
Figure 11B:
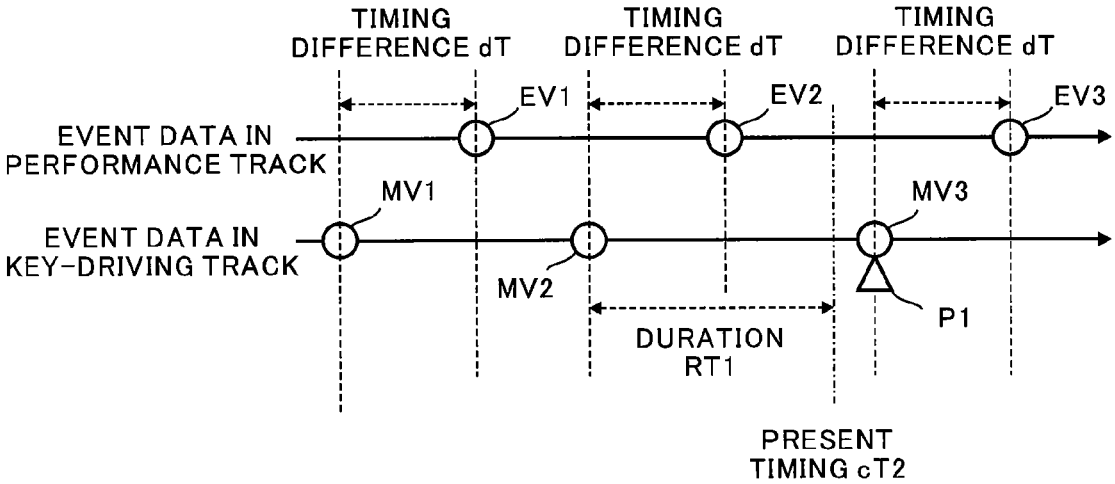

FIG. 11A and FIG. 11B are schematic diagrams for explaining the process for processing the key-driving event just before paused position shown in FIG. 10.

FIG. 11A shows a case when the step-back reproduction is necessary. Reproduction of this performance data PD has been paused at the present timing cT1, and the pointer P1 of the driving track is positioned at the driving event MV3. Moreover, the driving events MV1 to MV3 in the diagram respectively correspond to the performance events EV1 to EV3.

When the process for processing the key-driving event just before paused position shown in FIG. 10 is executed in the above-described condition, the event MV2 positioned just before the MV3 where the present pointer P1 is positioned is read out. A value (number of ticks) of the timing of the event MV2 added with the timing difference dT is a position of the event EV2; however, it is positioned after the present timing cT1 (number of ticks of the value of the timing of the event MV2 added with the timing difference dT is larger than number of ticks of the present timing cT1). That is, because an interval (the duration RT1 in the diagram) between the present timing cT1 and the event MV2 is shorter than the timing difference dT, the process proceeds to Step SD4, and the timing of the event MV2 is set to the step-back timing register. Thereafter, the event MV1 just before the event MV2 is read out at Step SD5. Therefore, the process proceeds to Step SD6 because an interval (the duration RT2 in the diagram) between the present timing cT1 and the event MV1 is longer than the timing difference dT. Thereafter, the driving track is reproduced from the event MV2 at Step SD7, and the reproduction after the present timing cT1 is restarted at Step SA11 in FIG. 4.

FIG. 11B shows a case when the step-back reproduction is unnecessary and the same performance data PD as in FIG. 11A is reproduced. Reproduction of this performance data PD has been paused at the present timing cT2, and the pointer P1 of the driving track is positioned at the driving event MV3. Moreover, the driving events MV1 to MV3 in the diagram respectively correspond to the performance events EV1 to EV3.

When the process for processing the key-driving event just before paused position shown in FIG. 10 is executed in the above-described condition, the event MV2 positioned just before the MV3 where the present pointer P1 is positioned is read out. A value (number of ticks) of the timing of the event MV2 added with the timing difference dT is a position of the event EV2, and it is positioned before the present timing cT2 (number of ticks of the value of the timing of the event MV2 added with the timing difference dT is smaller than number of ticks of the present timing cT1). That is, because an interval (the duration RT1 in the diagram) between the present timing cT2 and the event MV2 is longer than the timing difference dT, the process proceeds to Step SD6 without setting the step-back timing register. Because the step-back timing register has not been set, the process is finished at Step SD8, and the reproduction after the present timing cT2 is restarted at Step SA11 in FIG. 4. Moreover, in this case, the driving event MV1 is not read out.

Moreover, although the driving tracks MTD formed based on the performance data PD are recorded unitedly as driving data MD in the above-described embodiment, the formed driving tracks MTD may be recorded with the performance track PTD as a part of tracks in the performance data PD.

The present invention has been described in connection with the preferred embodiments. The invention is not limited only to the above embodiments. It is apparent that various modifications, improvements, combinations, and the like can be made by those skilled in the art.

What is claimed is:

1. An electronic keyboard instrument comprising:

a storage device that stores automatic performance data including a first type of event for generating a musical tone and first timing data that defines a reproduction timing of the first type of event, and key-driving data including a second type of event corresponding to the first type of event included in the automatic performance data and second timing data that defines a reproduction timing of the second type of event and precedes the first timing data for a predetermined time;

a keyboard that has a plurality of keys;

a key driver that drives each of the plurality of keys in accordance with the key-driving data;

a driving controller that turns on and off key-driving of the key driver;

a reproduction device that reproduces the automatic performance data and the key-driving data in parallel; and a reproduction controller that detects an event which appears first in the automatic performance data or the key-driving data when the reproduction device starts reproduction and controls the reproduction device to reproduce the automatic performance data and the key-driving data rapidly until the detected event and to reproduce the automatic performance data and the key-driving data at a reproduction tempo set by tempo change event or by an operation of a user after the detected event, wherein the reproduction controller detects an event which appears first only in the automatic performance data when the key driving is turned off.

2. The electronic keyboard instrument according to claim 1, further comprising a key-driving data generator that generates the key-driving data based on the automatic performance data before reproduction by the reproduction device.

3. The electronic keyboard instrument according to claim 1, wherein the predetermined time corresponds to duration from a time when driving of a key is started to a time when the key is in a condition of being pressed.

4. The electronic keyboard instrument according to claim 1, wherein the key-driving data includes a plurality of tracks, one of which can be selected as a key-driving target track; and the reproduction controller detects an event which appears first in the automatic performance data or the selected track of the key-driving data.

5. A storage medium storing a program to be executed by an electronic keyboard instrument comprising a storage device that stores automatic performance data including a first type of event for generating a musical tone and first timing data that defines a reproduction timing of the first type of event, and key-driving data including a second type of event corresponding to the first type of event included in the automatic performance data and second timing data that defines a reproduction timing of the second type of event and precedes the first timing data for a predetermined time, a keyboard that has a plurality of keys, a key driver that drives each of the plurality of keys in accordance with the key-driving data, and a driving controller that turns on and off key-driving of the key driver, the program comprising the instructions for:

reproducing the automatic performance data and the key-driving data in parallel;

detecting an event which appears first in the automatic performance data or the key-driving data when the reproduction instruction starts reproduction, wherein detection occurs only in the automatic performance data when the key driving is turned off; and controlling the reproduction device to reproduce the automatic performance data and the key-driving data rapidly until the detected event and to reproduce the automatic performance data and the key-driving data at a reproduction tempo set by tempo change event or by an operation of a user after the detected event.

* * * * *